US006971962B2

(12) United States Patent
Kasashima et al.

(10) Patent No.: US 6,971,962 B2
(45) Date of Patent: Dec. 6, 2005

(54) GOLF BALL

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 54 days.

(21) Appl. No.: 10/685,491

(22) Filed: Oct. 16, 2003

(65) Prior Publication Data

US 2004/0087389 A1 May 6, 2004

(30) Foreign Application Priority Data

Oct. 25, 2002 (JP) ..... 2002-310950

(51) Int. Cl.[7] ..... A63B 37/12; A63B 37/14
(52) U.S. Cl. ..... 473/383; 473/378
(58) Field of Search ..... 473/378–384

(56) References Cited

U.S. PATENT DOCUMENTS 922,773 A * 5/1909 Kempshall ..... 473/383
1,517,514 A * 12/1924 Hunt ..... 473/383
1,666,699 A * 4/1928 Hagen ..... 473/383
1,681,167 A * 8/1928 Beldam ..... 473/383
4,560,168 A * 12/1985 Aoyama ..... 473/379
5,145,180 A * 9/1992 Oka ..... 473/382
5,916,044 A * 6/1999 Shimosaka et al. ..... 473/384
6,139,448 A * 10/2000 Sullivan ..... 473/384
6,290,615 B1 * 9/2001 Ogg ..... 473/378
6,383,092 B1 * 5/2002 Ogg ..... 473/378
6,461,253 B2 * 10/2002 Ogg ..... 473/378
6,471,605 B2 * 10/2002 Ogg ..... 473/383
6,595,876 B2 7/2003 Kasashima
6,620,060 B2 * 9/2003 Ogg et al. ..... 473/377
6,626,772 B1 * 9/2003 Kennedy, III ..... 473/384
6,632,150 B1 * 10/2003 Ogg ..... 473/378
6,634,965 B2 * 10/2003 Yagley et al. ..... 473/378

* cited by examiner

*Primary Examiner*—Gregory Vidovich
*Assistant Examiner*—Alvin A. Hunter, Jr.
(74) *Attorney, Agent, or Firm*—Sughrue Mion, PLLC

(57) ABSTRACT

The present invention is a golf ball which has a spherical surface which is integrally provided with a plurality of annular ridges. The annular ridges are effective for reducing the air resistance of the ball in flight and thus drastically improving the flight performance. Further, at least some of the annular ridges may intersect with each other, including those which have an equal size.

12 Claims, 4 Drawing Sheets

GOLF BALL

TECHNICAL FIELD

This invention relates to golf balls having a unique appearance and improved flight performance.

BACKGROUND ART

As is well known in the art, in order for a golf ball to travel a distance when launched, the rebound properties of the ball itself and the sophisticated arrangement of dimples on the ball surface to reduce the air resistance of the ball in flight are important. To reduce the air resistance, many methods of uniformly arranging dimples over the entire ball surface at a higher density have been proposed.

Most often, dimples are indentations of circular shape as viewed in plane. To arrange such circular dimples at a high density, it will be effective to reduce the width of a land partitioning two adjoining dimples to nearly zero. However, the region surrounded by three or four circular dimples becomes a land of generally triangular or quadrangular shape having a certain area. On the other hand, it is requisite to arrange dimples on the spherical surface as uniformly as possible. Thus the arrangement density of circular dimples must find a compromise.

Under the circumstances, Kasashima et al., U.S. Pat. No. 6,595,876 (JP-A 2001-212260) attains the purpose of uniformly arranging dimples on a golf ball at a high density, by arranging dimples of 2 to 5 types having different diameters on the spherical surface of the ball which is assumed to be a regular octahedron or icosahedron.

However, as long as circular dimples are used, the percent occupation of the total dimple area over the entire spherical surface area encounters a practical upper limit of approximately 75% (or the percent occupation of the total land area is approximately 25%). In order to further reduce the air resistance of a ball in flight, it is required to increase the percent occupation of the total dimple area over the entire spherical surface area.

SUMMARY OF THE INVENTION

An object of the invention is to provide a golf ball of unique surface design having improved flight performance.

It has been discovered that the flight performance of a golf ball is improved by arranging annular raised ridge-like lands on the spherical surface in good balance so as to give a unique design, and more particularly by arranging a plurality of annular or closed-loop ridges on the spherical surface without engraving or recessing the spherical surface to form dimples.

According to the present invention, there is provided a golf ball having a spherical surface which is integrally provided with a plurality of annular raised ridges.

In a preferred embodiment, at least some annular ridges intersect with each other. In a more preferred embodiment, annular ridges having an equal size intersect with each other, and/or annular ridges having different sizes intersect with each other. In a further preferred embodiment, at least one annular ridge having a relatively small diameter is disposed inside an annular ridge having a relatively large diameter.

Typically, the annular ridge has a top of arcuate contour, preferably having a radius of curvature of 0.2 to 2.0 mm. The annular ridge preferably has a height of 0.05 to 0.4 mm from the spherical surface.

In a preferred embodiment, the annular ridges are arranged in accordance with the spherical icosahedral or octahedral pattern.

DESCRIPTION OF THE PREFERRED EMBODIMENTS

Figure 1:
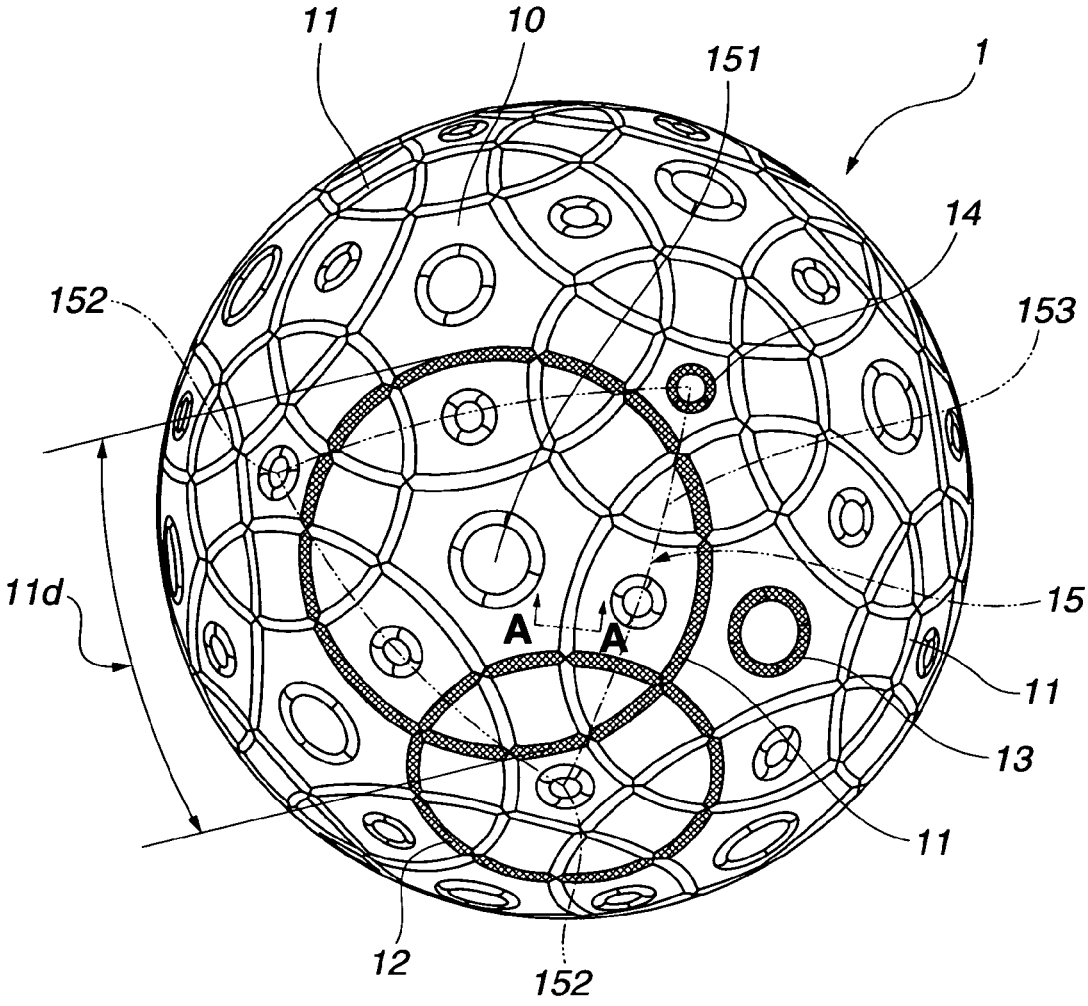
FIG. 1 is a plan view of a golf ball according to a first embodiment of the invention.

In most prior art golf balls, dimples or indentations are formed on their spherical surface. It is known that the higher the percent occupation of dimples on the spherical surface, the better becomes the ball's flight performance. Rather than arranging the dimples that are formed on the golf ball spherical surface by engraving the same, the present invention uses annular ridges that protrude from the spherical surface and look like lands and focuses on the topography of the golf ball surface given by these ridges.

When an imaginary spherical surface is drawn as circumscribing the top of ridges, the top surface of ridges corresponds to the remainder of the spherical surface after dimples are arranged, that is generally designated "land as the spherical surface" in the prior art. Then, reducing the proportion of the surface area of ridge tops in the golf ball surface area can achieve the same effect as the effect of reducing the proportion of the total area of lands left as the spherical surface (the remainder of the spherical surface) after arrangement of dimples in the entire spherical surface area, as is known in the prior art. Additionally, by forming the ridges which are annular as viewed in plane, and arranging them on the spherical surface in good balance, the present invention is successful in improving the aerodynamic performance of the golf ball in flight and thus offering an increased travel distance.

Each annular raised ridge on the spherical surface is a protrusion which is annular as viewed in plane and looks like a land. The annular ridge may be either a circular annular ridge or a polygonal annular ridge (preferably regular polygonal annular ridges) including triangular, quadrangular and pentagonal annular ridges. As long as the aesthetic appearance and other objects are not compromised, annular ridges of somewhat deformed circular shape or deformed annular ridges each consisting of segments connected to define a region of non-circular shape on the spherical surface may be used in combination. In the practice of the invention, circular annular ridges are most preferred.

Where annular ridges which are circular as viewed in plane are used, their diameter is not particularly limited. The diameter may vary over a range. For example, even an annular ridge of the largest circle equal to the diameter of the spherical surface is applicable. An embodiment wherein an annular ridge of the largest circle is formed in register with the parting line of a split mold (i.e., equator of the spherical cavity of the mold) often used in the molding of golf balls is advantageous for ball molding because trimming burrs on the molded ball at the parting line of the mold becomes easy.

In the golf ball of the invention, a plurality of annular ridges are arranged on the spherical surface. As long as at least two annular ridges are included, the total number of annular ridges is not critical. A suitable number of annular ridges are arranged on the spherical surface in good balance while taking into account the shape and size of annular ridges. Preferably 50 to 500 annular ridges are used.

For arranging annular ridges on the spherical surface in good balance, a spherical icosahedron, spherical dodecahedron or spherical octahedron may be utilized as the reference polyhedron for the arrangement of annular ridges.

In the golf ball of the invention, the annular ridges are arranged on the spherical surface such that the annular ridges may be independent from each other, or all the annular ridges intersect with each other, or only some annular ridges intersect with each other. In an alternative embodiment, one or more annular ridges having a relatively small diameter are disposed inside an annular ridge having a relatively large diameter.

Figure 4:
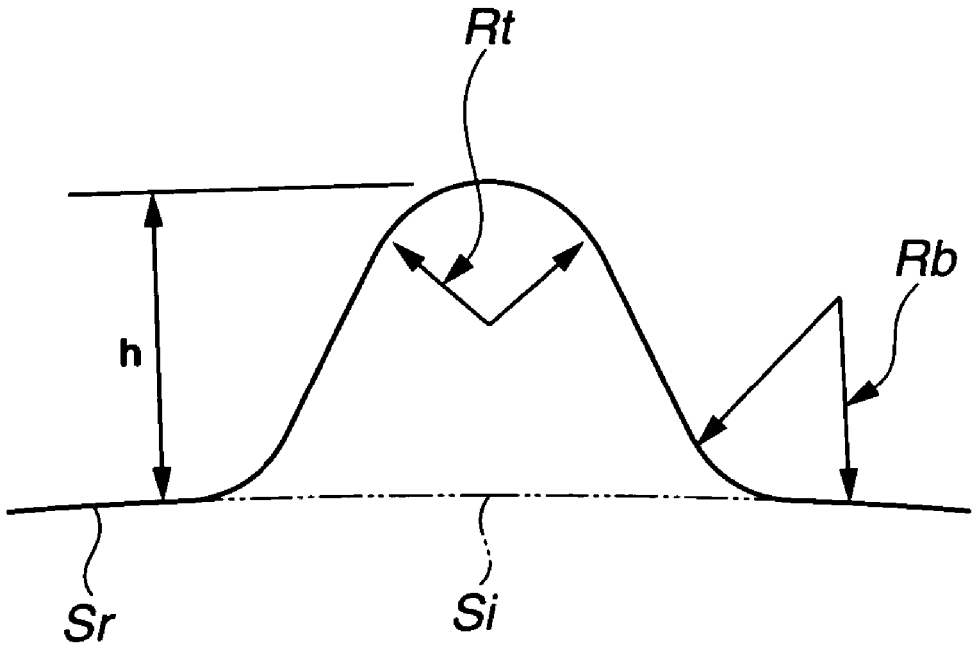
FIG. 4 is a schematic view taken along lines A—A in FIG. 1 showing the cross section of an annular ridge.

As seen from the cross section shown in FIG. 4, each annular ridge has a top and a pair of skirts smoothly connecting the top to the spherical surface. The contour of the top of the annular ridge may be determined as appropriate as long as the objects of the invention are not compromised. The ridge top may have an arcuate shape, parabolic shape, or polygonal shape (preferably regular polygon shape) including triangle, quadrangle and pentagon shapes. For reducing the area of a ridge at its top (corresponding to the area of a "land as the spherical surface" in the prior art) and increasing the durability thereof, the ridge top preferably has an arcuate or parabolic contour.

For the ridge whose top has an arcuate contour, the arc preferably has a radius of curvature of 0.2 mm to 2.0 mm. If the radius of the arc is less than 0.2 mm, the ridges may become less durable in that they are likely to be scraped when hit with a club. If the radius of the arc is more than 2.0 mm, the area of the ridge top may become too large, resulting in increased air resistance.

The contour of the skirt smoothly connecting the top to the spherical surface may also be determined as appropriate as long as the objects of the invention are not compromised. Preferably the ridge skirt has an arcuate contour which is convex toward the center of the golf ball because it is desired that when the golf ball is painted, a paint film be uniformly formed on the spherical surface including ridges, and when logo and other marks are printed on the golf ball, the spherical surface including ridges be receptive to such marks.

For the ridge whose skirt has an arcuate contour which is convex toward the center of the golf ball, the arc preferably has a radius of curvature of 0.5 mm to 10 mm. Outside the range, a paint film may not be uniformly formed on the spherical surface including ridges when the golf ball is painted, or the spherical surface including ridges may become less receptive when marks are printed on the golf ball.

As seen from the cross section shown in FIG. 4, each annular ridge has a height "h" as measured between the top and the spherical surface which is generally 0.05 mm to 0.4 mm, preferably 0.1 mm to 0.25 mm. If the height is less than 0.05 mm or more than 0.4 mm, the golf ball may have less desirable aerodynamic characteristics and hence, a shorter travel distance. It is preferred from the standpoint of aerodynamic performance that all the annular ridges have an equal height over the entire surface of the golf ball.

Each annular ridge may be either continuous or discontinuous along the specific plan view shape.

The radius of the golf ball is determined as appropriate so as to meet the rules of golf. As used herein, the radius of the golf ball is the radial distance from the center of the golf ball to the top of the annular ridges.

In the golf ball whose surface is constructed as above, the proportion of the surface area of the annular ridges at their top (corresponding to the area of lands left as the spherical surface (i.e., remainder of the spherical surface) after arrangement of dimples in the prior art) in the surface area of an imaginary spherical surface having the golf ball radius (circumscribing the top of the annular ridges) is very low. Particularly when the ridge top has an arcuate or parabolic contour, the proportion of the surface area of the annular ridges at their top in the surface area of an imaginary spherical surface having the golf ball radius or simply the ball surface area can be reduced to substantially 0% or a value of nearly 0%. This is effective for reducing the air resistance of the ball in flight.

Referring to FIGS. 1 to 4, the invention is described in more detail. In the following embodiments, the circular annular shape is simply described as annular shape.

FIG. 1 illustrates a golf ball 1 according to a first embodiment of the invention.

The golf ball 1 has a spherical surface 10 which is integrally provided with annular raised ridges 11, 12, 13 and 14 of four types. Annular ridges of four types are used in combination. Each of the annular ridges 11 to 14 has a circular shape as viewed in plane. The annular ridges 11 having the largest diameter 11*d* and the annular ridges 12, 13 and 14 having sequentially decreasing diameters are arranged on the spherical surface 10 in good balance.

When annular ridges are arranged on the golf ball 1, the arrangement pattern based on the assumption that the sphere be an icosahedron is utilized. A triangular unit 15 constituting the spherical icosahedron is shown by dot-and-dash lines in FIG. 1. Annular ridges 11 and 13 are disposed concentric about the center 151 of the triangular unit 15, and annular ridges 12 and 14 are disposed concentric about each of the three apexes 152 of the triangular unit 15. Although only one triangular unit 15 is illustrated in FIG. 1, twenty triangular units are distributed over the entire spherical surface, and annular ridges 11 to 14 are arranged in conjunction with each triangular unit as described above. Accordingly, the apexes of five adjacent triangular units are commonly positioned at each apex of one triangular unit 15, and one fifth of the entirety of the annular ridges 12, 14 are located within that triangular unit 15.

In the golf ball 1, the annular ridge 11 intersects with three annular ridges 12 centered at the apexes 152 of the triangular unit 15, and also intersects, on the sides 153 of the triangular unit 15, with three other annular ridges 11 similarly disposed concentric about the center of adjacent triangular units (not depicted).

Within the annular ridge 11, a relatively small annular ridge 13 is concentrically disposed. Similarly, within the annular ridge 12, a relatively small annular ridge 14 is concentrically disposed. The small annular ridge 14 is disposed at the center of each side 153 of the triangular unit 15 as well.

In the illustrated arrangement wherein relatively large annular ridges 11 and 12 are disposed in mutual intersection and relatively small annular ridges 13 and 14 are disposed within them, the spherical surface is partitioned into small zones of complex shapes including triangular, quadrangular, deformed hexagonal and circular shapes in good balance.

Since relatively large annular ridges are disposed on the golf ball 1, as seen from FIG. 1, the annular ridges 11 and 12 intersect or interfere with each other to define small zones of complex shapes on the spherical surface.

Figure 2:
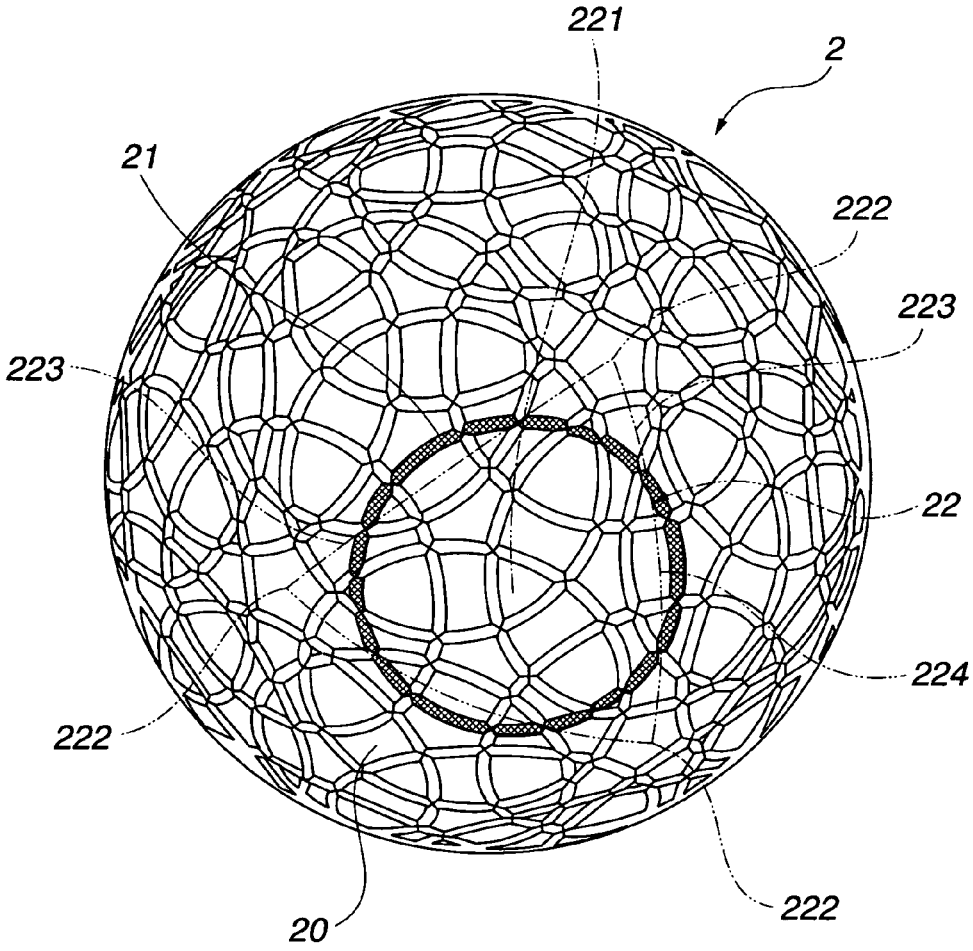
FIG. 2 is a plan view of a golf ball according to a second embodiment of the invention.

FIG. 2 illustrates a golf ball 2 according to a second embodiment of the invention. The golf ball 2 is characterized in that relatively large annular ridges 21 of the same type are arranged on the spherical surface 20 in good balance. In arranging the annular ridges 21 on the golf ball 2, a spherical icosahedron is utilized as the reference. A triangular unit 22 constituting the spherical icosahedron is shown by dot-and-dash lines in FIG. 2.

More particularly, annular ridges 21 are disposed and centered at the center 221, the apexes 222, and the centers 224 of the sides 223 of the triangular unit 22, respectively. The annular ridge 21 has such a size that the annular ridge, when disposed concentric with the triangular unit 22, extends somewhat out of the sides 223 of the triangular unit 22 as seen from FIG. 2.

When annular ridges of such size are arranged in the above-described fashion, three annular ridges centered at the apexes 222 of the triangular unit 22, three annular ridges centered at the centers 224 of the sides 223 of the triangular unit 22, and one annular ridge centered at the center 221 of the triangular unit 22 intersect with each other. Additionally, the annular ridge centered at the center 221 of the triangular unit 22 intersects, on each side of the triangular unit 22, with an annular ridge centered at the center of an adjacent triangular unit (not depicted). This arrangement of annular ridges partitions the spherical surface into a balanced combination of zones of complex shapes including triangular, quadrangular, trapezoidal and pentagonal shapes.

Figure 3:
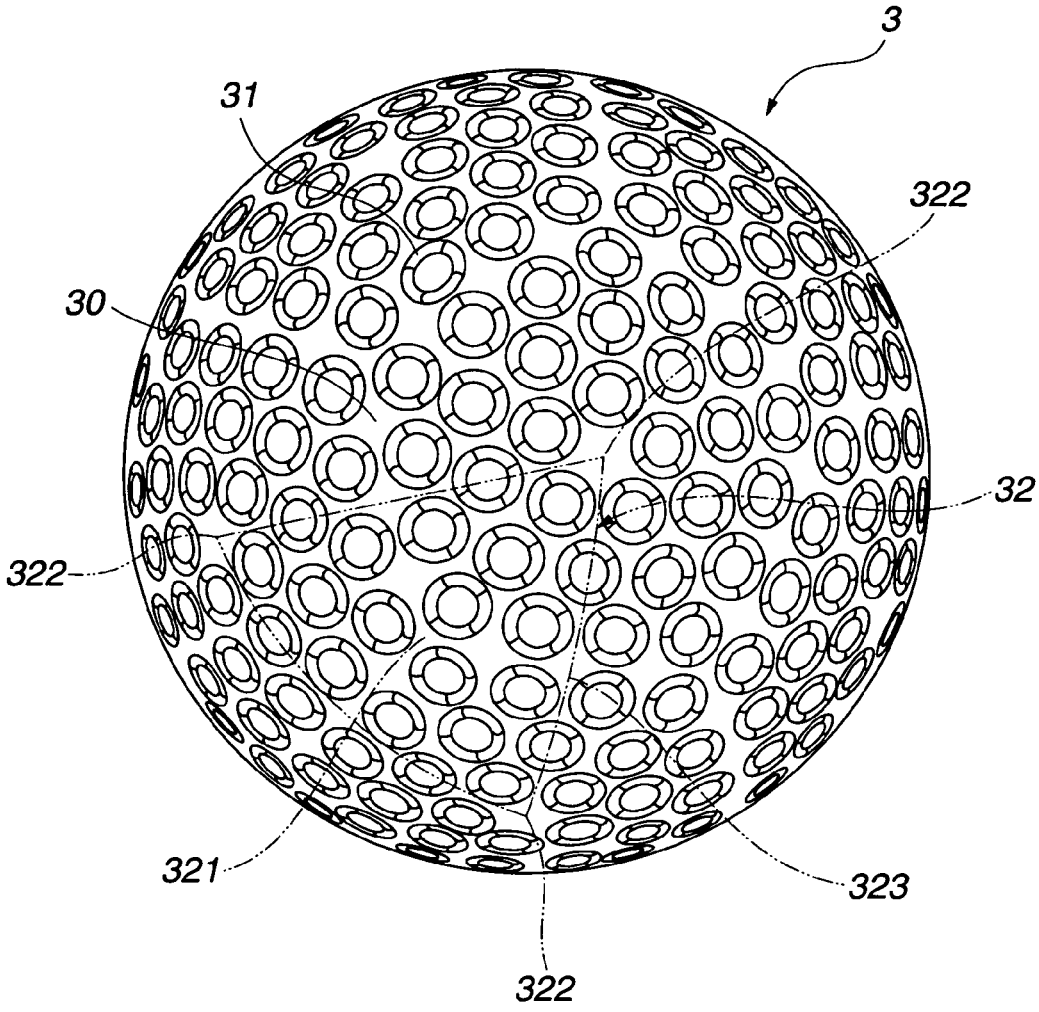
FIG. 3 is a plan view of a golf ball according to a third embodiment of the invention.

FIG. 3 illustrates a golf ball 3 according to a third embodiment of the invention. The golf ball 3 is characterized in that relatively small annular ridges 31 of the same type are arranged on the spherical surface 30 in good balance without mutual intersection. In arranging the annular ridges 31 on the golf ball 3, a spherical icosahedron is utilized as the reference. A triangular unit 32 constituting the spherical icosahedron is shown by dot-and-dash lines in FIG. 3.

More particularly, as shown in FIG. 3, fifteen annular ridges 31 are uniformly arranged within a triangular unit 32, and two annular ridges 31 are arranged on each side 323 of the triangular unit 32 at points of ¼ and ¾ of its length so that these annular ridges extend over an adjacent triangular unit (not depicted).

FIG. 4 shows, in cross-section taken along lines A—A in FIG. 1, an annular ridge on the surface of the golf ball 1 shown in FIG. 1. The ridges on the golf balls 2 and 3 have a similar cross-sectional shape.

As shown in FIG. 4, the ridge at its top has an arcuate contour in cross section. The arcuate contour of the ridge top has a radius of curvature Rt. The ridge has a height "h" as measured from an imaginary spherical surface Si which is an extension of the spherical surface Sr.

In the golf balls 1 to 3 according to the different embodiments of the invention, the skirt of the ridge that extends from the top to the spherical surface has an arcuate contour which is convex toward the center of the golf ball. The arcuate contour of the ridge skirt has a radius of curvature Rb. It is understood that in the cross section of the ridge shown in FIG. 4, the top of the ridge which is one of the references for the definition of height "h" corresponds to the land in conventional dimpled golf balls.

There has been described a golf ball having a plurality of annular ridges on its surface, which are effective for reducing the air resistance of the ball in flight and thus drastically improving the flight performance.

Japanese Patent Application No. 2002-310950 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball having a spherical surface which is integrally provided with a plurality of circular annular raised ridges protruded from the spherical surface, wherein at least some circular annular ridges intersect with each other.

2. The golf ball of claim 1 wherein annular ridges having an equal size intersect with each other.

3. The golf ball of claim 1 wherein annular ridges having different sizes intersect with each other.

4. A golf ball having a spherical surface which is integrally provided with a plurality of circular annular raised ridges, wherein at least one circular annular ridge having a relatively small diameter is disposed inside another circular annular ridge having a relatively large diameter.

5. The golf ball of claim 1 wherein the annular ridge has a top of arcuate contour.

6. The golf ball of claim 5 wherein the arcuate contour has a radius of curvature of 0.2 to 2.0 mm.

7. The golf ball of claim 1 wherein the annular ridge has a height of 0.05 to 0.4 mm from the spherical surface.

8. A golf ball having a spherical surface which is integrally provided with a plurality of annular raised ridges protruded from the spherical surface, wherein the annular ridges are arranged in accordance with the spherical icosahedral or octahedral pattern, and at least some annular ridges intersect with each other.

9. The golf ball of claim 1, wherein at least some annular ridges intersect with each other to define small zones of complex shapes on the spherical surface.

10. A golf ball having a spherical surface which is integrally provided with a plurality of annular raised ridges protruded from the spherical surface, wherein at least some annular ridges intersect with each other to define small zones of complex shapes on the spherical surface which include triangular, quadrangular, hexagonal, trapezoidal and pentagonal shapes.

11. A golf ball having a spherical surface which is integrally provided with a plurality of annular raised ridges protruded from the spherical surface, wherein the annular ridges are arranged in accordance with the spherical icosahedral pattern and the annular ridges are centered at the apexes of the triangular unit which is a constituent of the icosahedral pattern and at least some annular ridges intersect with each other.

12. The golf ball of claim 1, wherein the total number of annular ridges is 50 to 500.

* * * * *